United States Patent [19]

Logsdon

[11] Patent Number: 5,072,461

[45] Date of Patent: Dec. 17, 1991

[54] MOVABLE FITTING MEMBERS FOR USE WITH DRAIN FITTINGS

[75] Inventor: Duane D. Logsdon, Fullerton, Calif.

[73] Assignee: The Logsdon Foundation, Fullerton, Calif.

[21] Appl. No.: 613,117

[22] Filed: Nov. 14, 1990

[51] Int. Cl.[5] ..... A47K 1/14

[52] U.S. Cl. ..... 4/295; 4/204; 4/286; 4/287

[58] Field of Search ..... 4/295, 286, 287, 204, 4/205, 290, 291

[56] References Cited

U.S. PATENT DOCUMENTS

| | | | |
|---|---|---|---|
| 3,468,512 | 9/1969 | Politz | 4/295 X |
| 4,207,631 | 6/1980 | Baggey | 4/291 |
| 4,420,844 | 12/1983 | Puckett et al. | 4/295 |
| 4,597,112 | 7/1986 | Cuschera | 4/287 |
| 4,720,877 | 1/1988 | Watts | 4/286 |
| 4,908,883 | 3/1990 | Rivera | 4/286 X |
| 4,926,507 | 5/1990 | Craig jet al. | 4/204 X |

*Primary Examiner*—Daniel M. Yasich

*Attorney, Agent, or Firm*—Joseph C. Andras

[57] ABSTRACT

A movable fitting member such as a bathtub drain stopper can be constructed so as to be useful with different drain fittings which differ by having post holders with different sized openings into which a guide post can be threaded. Such a movable fitting member is constructed so as to use a body having a sleeve located around a post holder and having an enlarged cavity around the post holder within the body. The guide post used is double ended; one end is threaded into the post holder in a drain fitting and the other end is located within the cavity. A nut is located on this other end; it is sufficiently large so that it cannot pass through the sleeve. As a result of this the body cannot normally be separated from the guide post during the use of the fitting member.

9 Claims, 1 Drawing Sheet

MOVABLE FITTING MEMBERS FOR USE WITH DRAIN FITTINGS

BACKGROUND OF THE INVENTION

The invention set forth in this specification pertains to new and improved movable fitting members for use with drain fittings. It is presently believed that normally such fitting members will be formed so as to serve as stoppers or closures for the drain fittings in bath tubs or the like but, if desired, they can also be formed so as to be useful in connection with or as strainers or related items.

The drain fittings with which the fitting members of the present invention are primarily useful are normally constructed so as to include an upper annular rim which is shaped so as to be especially adapted to fit against the bottom of a tub or sink around a drain opening leading from the latter. These drain fittings usually include an externally threaded cylindrical sleeve which is attached to the interior of the annular lip so as to extend downwardly from the annular lip, inwardly extending arms carried by the lower end of the sleeve and a post holder carried by the arms.

The fitting members of the present invention are desired for use with drain fittings in which the post holder is a more or less nut like member having an internally threaded opening located in axial alignment with the cylindrical sleeve forming a part of the drain fitting. With this type of structure a threaded end on a post forming a part of a fitting of the invention can be screwed into the post holder so that the post projects upwardly through the center of the cylindrical sleeve.

In accordance with the invention the post carries a movable body in such a manner that the body can be moved relative to the drain fitting in order to accomplish a function. When the invention is used in the presently preferred manner this function will be that of opening and closing the drain opening. In other instances such a function may relate to moving a filter into and out of an operative position in a drain opening. From this it will be obvious that the body has to be constructed in a manner appropriate to its intended use.

Fortunately there is at least a degree of standardization of the drain fittings and fitting members. Thus, for example, the drain fittings for use with tub stoppers or the like in the U.S.A. are usually sized for use with standard sized openings in tub bottoms or the like. However, such standardization is of a somewhat limited scope as is evidenced by the fact that two different sized threaded holes in the post holders in fitting members serving as drain stoppers or closures are in common use in the U.S.A.

Several problems have been encountered in connection with prior movable fitting members in which the bodies are formed so as to be adapted to be used as drain stoppers or closures. One of these is that such fitting members have been relatively easy to steal after being installed in a tub, a wash basin or the like. Another is that it has normally been considered necessary to stock new fitting members for use in replacing stolen, damaged or worn out fitting members which have been specifically designed to be used in drain fittings from the specific manufacturer of such drain fittings.

This latter can be considered as a problem. Normally no plumber or plumbing supply house likes to carry any significant inventory of parts. It is clearly undesirable for a plumber or supply house to have to carry separate fitting members capable of serving as stoppers or the like for use with each of the common types of drain fittings currently being sold or in use in the U.S.A. It is considered that because of these considerations that there is a need for improvement in the field of the present invention.

BRIEF SUMMARY OF THE INVENTION

A broad objective of this invention is to fulfil this need. More specifically an objective of the invention is to provide new and improved fitting members such as stoppers or drain closures, strainers or the like which are of such a category that they can be easily and conveniently used as replacements for fitting members used with either of the two common types of drain fittings indicated in the preceding discussion. Because of the fact that the fitting members of the invention can be used with common types of drain fittings as noted a plumbing supply house or plumber will need to carry only a fitting member in accordance with this invention in order to have a single type of fitting member to meet commercial needs instead of having two of such fitting members in order to meet these needs.

A further objective of the invention are to provide fitting members as are indicated in the preceding discussion which are of nearly or substantially the same cost to manufacturer as prior related fittings. A still further objective of the invention is to provide fitting members as described which may be easily and conveniently installed and which can be used over prolonged periods under normal circumstances with little or no maintenance. A some- what related objective of the invention is to provide fitting members which will normally be installed in such a manner that they are relatively difficult to steal, but which are of such a character that they can be removed without significant difficulty for replacement or maintenance purposes.

In accordance with this invention these and other related objectives are achieved by providing a movable fitting member for use with a drain fitting which has an upper annular lip section for engaging a plumbing fixture, a cylindrical sleeve extending downward from the interior of said lip section, a threaded post holder located the center of the lower end of said sleeve, said post holder having an internally threaded opening which is axially aligned with said sleeve, arm means extending inwardly from the lower end of said sleeve and supporting said post holder, said fitting member including a post having a lower threaded end which is adapted to be threaded into said opening in said post holder so that said post extends upwardly along the axis of said cylindrical sleeve, said fitting member also including a movable body, said body including a guide sleeve fitting around said post in such a manner that said body can be moved so as to vary the relative position between said fitting member and said post in order to accomplish a flow control function in connection with liquid flowing through said fitting member from the top to the bottom thereof, in which the improvement comprises-said post also has an upper threaded end, the diameters of said threaded ends of said post being different so as to permit one end of said post to be threaded into an opening of one diameter in a post holder and so as to permit the other end of said post to be threaded into an opening of a different diameter in a different post holder when said post is inverted, said guide sleeve including an internal annular shoulder extending outwardly from the interior of said sleeve at a location remote from said lower threaded end, and nut means threaded on said upper end of said post, said nut means being sufficiently large so as to engage said shoulder in order to limit movement of said body relative to said post so as to prevent said body from being removed from said post during the normal use of said drain fitting.

BRIEF SUMMARY OF THE DRAWING

Because of the nature of the invention it is best more fully described with reference to the accompanying drawing in which.

Figure 1:
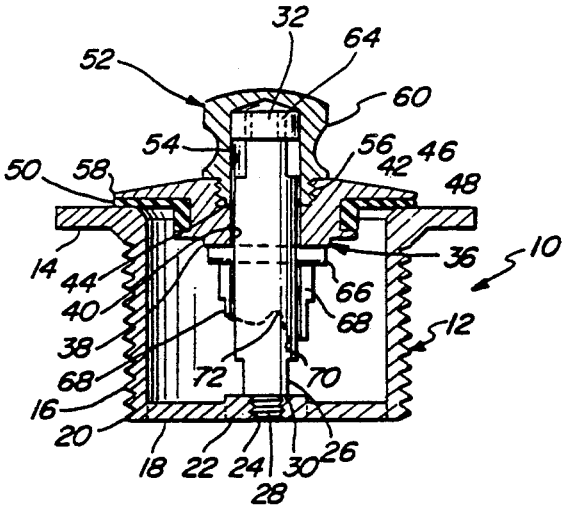
FIG. 1 is a cross-sectional view of a presently preferred embodiment or form of a movable fitting member in accordance with the invention installed in a drain fitting in which a centrally located post, a nut used with the post and a pin carried by the post have been shown in elevation, the fitting member being shown as located in a closed position in this figure.

For a consideration of this entire specification including the appended claims those skilled in the field of plumbing fittings such as drain stoppers and strainers will realize that the invention involves essentially intangible principles or concepts as are set forth and defined in the appended claims. These concepts can easily be embodied into other structures which differ from what is shown in the drawing in appearance and/or construction through the use or exercise of routine skill in the noted field. For this reason the invention is not to be considered as being limited to precisely what has been illustrated, but is to be considered as being limited by the appended claims.

DETAILED DESCRIPTION

In the drawing there is shown a movable fitting member 10 which is used with a drain fitting 12. Normally this drain fitting 12 will be of a standardized construction and will include: an upper annular lip section 14 which is adapted to be used so that it engages a plumbing fixture (not shown) in a conventional manner; an externally threaded cylindrical sleeve 16 which is attached to and depends from the interior (not separately numbered) of the lip section 14; a series of arms 18 extending inwardly from the lower end 20 of the sleeve 16; and a post holder 22 having an internally threaded opening 24 supported by the arms 18.

It is to be understood that the precise construction of the drain fitting 12 can vary somewhat depending upon the desires of a manufacturer. When the drain fitting 12 is of current U.S. origin and is intended to be used with a drain fitting either constructed as the fitting 12 or as another related fitting member the opening 24 will normally be of either of two diameters and will be threaded in accordance with conventional practice in the U.S. plumbing industry. Regardless of the diameter of the opening 24 this opening will be located so that it is aligned with the center (not shown) of the sleeve 16. If desired this can be indicated by stating that the opening 24 and the sleeve 16 are in axial alignment.

It is also to be understood that the precise construction of the fitting member 10 can also be varied extensively depending upon the desires of a manufacturer. It will also vary depending upon the precise intended use of the fitting member 10. Thus, the construction of it will have to vary somewhat depending upon whether it is intended to be used as a stopper or drain closure or whether or not it is intended to be used as a strainer or the like. The particular fitting member 10 shown is constructed so as to be primarily useful as a stopper or drain closure.

It may be considered as including a cylindrical guide post 26 having a threaded lower end 28 of such diameter that this end 28 can be threaded into the opening 24 so that a shoulder 30 on the post 26 fits tightly against the holder 22 in order to securely hold the post 26 so that it extends upwardly through the sleeve 16 in axial alignment with the sleeve 16. The post 26 also has a threaded upper end 32 which is adjacent to a shoulder 34 corresponding to the shoulder 30. This upper end 32 differs from the lower end 28 only in its diameter. These two ends 28 and 32 are provided so that the post 26 can be inverted so as to be used with openings 24 of either of two different, reasonably standard U.S. sizes.

The fitting member 10 also includes a body 36 which is adapted to be moved linearly relative to the post 26. This body 36 is shaped so as to include a guide sleeve 38 having a lower internal bore 40 which fits closely around the post 26 as shown in order to "mount" the body 36 for this movement. Within this sleeve 38 an annular shoulder 42 extends outwardly from the bore 40 to a threaded internal bore 44 of larger diameter than the bore 40. The guide sleeve 38 also includes a comparatively large annular top flange 46 and an external annular flange or lip 48 which is parallel to and spaced from the top flange 46.

This body 36 also includes a conventional annular somewhat elastomeric, natural or synthetic rubber sealing washer 50 which is held against the exterior (not separately numbered) of the body 36 between the flange 46 and the lip 48 so as to extend outwardly from the flange 46 a sufficient distance so as to be capable of fitting against the lip section 14 in order to form a seal with this lip section 14 when the fitting member 10 is in a closed position. The flange 46 is of such a size as to "back up" the washer 50 so that it cannot become wedged into the sleeve 16.

Figure 2:
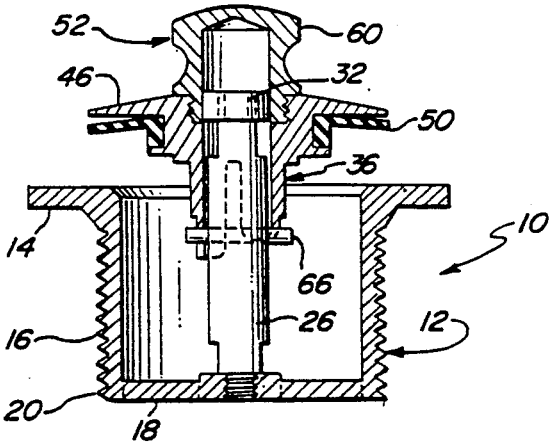
FIG. 2 is a view corresponding to FIG. 1 in which the drain fitting is shown in an open position.
Figure 3:
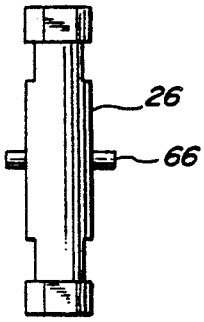
FIG. 3 is a side elevational view of the post illustrated in the preceding figures as it is supplied to a user with separate nuts on each of its ends in a "kit" containing the remainder of the fitting member.
Figure 4:
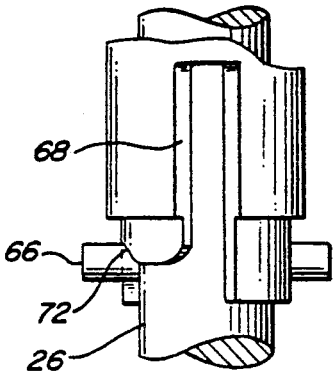
FIG. 4 is a partial side elevational view showing the lower end of a guide sleeve employed in the fitting member illustrated in FIGS. 1 and 2.

A nearly or generally cylindrical cap 52 is used in order to move the fitting member 10—including the body 36—between open and closed positions as shown in FIGS. 1 and 2. This cap 52 includes a centrally located cylindrical bore 54 which is adapted to accommodate the upper end 32 of the post 26. This bore 54 should preferably be slightly larger in diameter than the bore 40 but should be of lesser diameter than the bore 44. The reason for this will be subsequently apparent. The cap 52 also includes a threaded lower end 56 which is threaded within the bore 44 so as to secure the cap 52 to the body 36.

If desired an external flange 58 can be located on the exterior of the cap 52 so that it will engage the flange 46 in order to limit the distance or amount that the end 56 can be threaded into the bore 44. Normally a knurled rim 60 will be located on the cap 52 so as to facilitate its being manipulated. If desired small sealing washers 62 can be used between the flange 58 and the flange 46 or can be used between the shoulder 42 and the end 56.

The fitting member 10 also includes a nut means for preventing the body 36 from being removed from the post 26 during normal use. The nut means is preferably comprised of an internally threaded nut or nut like cylinder 64 having an internally threaded opening which is threaded upon the upper end 32 of the post 26. This nut 64 is of such external dimension that it can slide freely with the bore 54 in the cap 52 but is also of sufficient diameter so as to be incapable of entering the bore 40. As a consequence of its dimensions the shoulder 42 is capable of hitting against the nut 64 as the cap 52 is pulled upwardly so as to limit the amount that the fitting member 10—and more specifically the body 36 can be moved generally away from the drain fitting 12 from a lower, closed position as shown in FIG. 1 to an upper, open position as shown in FIG. 2 in allowing flow through the drain fitting 12.

During such motion a small cross pin 66 located is preferably fixed midway along the length of the post 26 so as to extend from diametrically opposite sides (not separately numbered) of the post 26 will slide within opposed, axially extending slots 68 in the sleeve 38 until such time as the pin 66 is adjacent to a flat bottom 70 of the sleeve 38. At least one of these slots 68 is required. As shown the bottom 70 extends perpendicular to the sleeve 66 so that when the pin 66 is out of the slots 68 the cap 52 can be manipulated to move the pin 66 beneath the bottom 70 in order to support the body 36 and various associated parts as previously noted so that the fitting member 10 is in an open position. If desired small notches 72 can be located along the bottom 70 to engage the pin 66 in order to restrict the chances of the body 36 being inadvertently rotated so as to be opposite the slots 68 in a position in which gravity might cause the body 36 to fall to a closed position.

Figure 5:
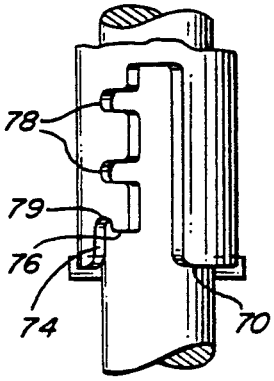
FIG. 5 is a view which is similar to FIG. 4 of a modified lower end of a guide sleeve capable of being used with a fitting member which is the same as the fitting member illustrated in FIGS. 1 and 2 except for the substitution of this lower end.

It is to be emphasized that it is not necessary that the sleeve 38 be shaped exactly as described in the preceding. An alternative sleeve 38' which at the time of the preparation of this specification is considered as possibly being preferable to the previously described structure is illustrated in FIG. 5. Since the alternative or modified structure shown in FIG. 5 only involves a simple addition to the previously described fitting structure 10 all parts shown in this figure which have been previously described are designated in this figure and in this description of FIG. 5 by the numerals used to designate such parts.

The modified sleeve 38' differs from the sleeve 38 as previously described by including small rectangular appearing cut-outs or notches 74 located in the sleeve 38' generally between or at the intersection of the bottom 70 and slots 68. Although two of these cuts 74 can be used with each slot 68 currently it is believed that it is most desirable to use only one of these cut-outs with each slot 68. These cut-outs 74 have flat upper surfaces 76 which extend parallel to the bottom 70. With this construction the pin 66 will normally be used in connection with these surfaces 76 in supporting the body 36 in an open position. It is considered optional but desirable to use small notches 79 corresponding to the previously described notches 72 at the ends of the surfaces 76 remote from the slots 68.

This manner of construction is desirable since when the pin 66 is against a surface 76 a user will have little difficulty in recognizing whether or not the cap 52 is being turned so that it will move to a closed position or not. If desired small notches 78 can be located along the lengths of the slots 68 so as to hold the pin 66 in various positions which are intermediate to the open and closed positions of the body 36 as described. This may be desirable when it may be desired to regulate the rate of flow through the drain fitting 12.

As normally supplied a fitting member 10 of the invention will have the post 26 separate from the body 36 and the cap 52 may or may not be disassembled from the body 36. As supplied separate nuts 64 will be threaded on both of the ends 28 and 32 of the post 26. During the installation of the fitting member the installer will determine which of the ends 28 and 32 fits the particular opening 24 in a drain fitting 12 in which the fitting member 10 is to be installed and then will throw away the nut from the end that fits. Next the post 26 will be threaded into position as shown.

In order that it can be threaded in place tightly enough so that it can only be removed with difficulty as a precaution against the fitting 10 being stolen it is preferred to locate parallel, opposed flat surfaces 80 adjacent to the ends 28 and 32. The latter can conveniently be engaged by a conventional wrench (not shown) in order to tighten the post 26 in position. Following this guide sleeve 38 is slid into place as shown. Next the nut 64 will be threaded in place on the upper end 26 of the post 24.

If washers 50 are used, after such washers 50 have been located in position the installation of the fitting member 10 is completed by tightening the cap 52 in position as shown. To facilitate the cap 52 being tightened down adequately flat surfaces 82 capable of being engaged by a wrench (not shown) can be located on the sleeve 38 adjacent to the slots 68. During such tightening normally the rim 60 can be held by a conventional tool (not shown). When the cap 52 is adequately tightened down, the fitting member will normally be held so tightly that it is difficult to steal.

Normally it will seldom be necessary to remove a fitting member 10 from a drain fitting 12 once the fitting member 10 is installed. When necessary for maintenance or replacement purposes the fitting 10 can be removed from a drain fitting by reverse of the steps indicated in the preceding discussion.

I claim:

1. A movable fitting member for use with a drain fitting which has an upper annular lip section for engaging a plumbing fixture, a cylindrical sleeve extending downward from the interior of said lip section, a threaded post holder located at the center of the lower end of said sleeve, said post holder having an internally threaded opening which is axially aligned with said sleeve, arm means extending inwardly from the lower end of said sleeve and supporting said post holder, said fitting member including a post having a lower threaded end which is adapted to be threaded into said opening in said post holder so that said post extends upwardly along the axis of said cylindrical sleeve, said fitting member also including a movable body, said body including a guide sleeve fitting around said post in such a manner that said body can be moved so as to vary the position of said body relative to said fitting member and said post in order to accomplish a flow control function in connection with liquid flowing through said fitting member from the top to the bottom thereof, in which the improvement comprises said post also has an upper threaded end, the diameters of said threaded ends of said post being different so as to permit one end of said post to be threaded into an opening of one diameter in a post holder and so as to permit the other end of said post to be threaded into an opening of a different diameter in a different post holder when said post is inverted, said guide sleeve including an internal annular shoulder extending outwardly from the interior of said sleeve at a location remote from said lower threaded end, and nut means threaded on said upper end of said post for preventing said body from being removed from said post during the normal use of said drain fitting, said nut means being sufficient large so as to engage said shoulder in order to limit movement of said body relative to said post.

2. A fitting member as claimed in claim 1 including:

another nut means which is supplied with said fitting member as a kit, said other nut means being capable of being threaded on the end of said post previously identified as said lower end of said post when said post is inverted, said other nut means being sufficiently large so as to engage said shoulder in order to limit movement of said body relative to said post so as to prevent said body from being removed from said post during the normal use of said drain fitting.

3. A fitting member as claimed in claim 1 wherein:

said guide sleeve includes a one longitudinal slot located so as to extend part way along its length from the lower end of said guide sleeve, and including a pin carried by said post, said pin being capable of fitting within said slot when body is in a lower position with respect to said drain fitting and being capable of fitting against the bottom of said sleeve in order to hold said body in an upper position with respect to said drain fitting after said body has been lifted to said upper position and turned so as to place said pin under said bottom.

4. A fitting member as claimed in claim 1 wherein:

said guide sleeve includes a one longitudinal slot located so as to extend part way along its length from the lower end of said guide sleeve and a rectangular cutout located at the intersection of said slot and the bottom of said guide sleeve, and including a pin carried by said post, said pin being capable of fitting within said slot when body is in a lower position with respect to said drain fitting and being capable of fitting against an edge of said cut-out in order to hold said body in an upper position with respect to said drain fitting after said body has been lifted to said upper position and turned so as to place said pin under said edge.

5. A fitting as claimed in claim 1 wherein:

said body includes an internal, annular, threaded wall extending upwardly from the exterior of said shoulder and said body includes a cap, said cap having a threaded exterior which is threaded into said internal annular wall in said body, said cap enclosing said nut means so as to prevent said post from being disassembled from said body in such a manner as to permit relative movement between said post and said body.

6. A fitting member as claimed in claim 5 wherein:

said guide sleeve includes a one longitudinal slot located so as to extend part way along its length from the lower end of said guide sleeve, and including a pin carried by said post, said pin being capable of fitting within said slot when body is in a lower position with respect to said drain fitting and being capable of fitting against the bottom of said sleeve in order to hold said body in an upper position with respect to said drain fitting after said body has been lifted to said upper position and turned so as to place said pin under said bottom.

7. A fitting member as claimed in claim 5 wherein:

said guide sleeve includes a one longitudinal slot located so as to extend part way along its length from the lower end of said guide sleeve and a rectangular cutout located at the intersection of said slot and the bottom of said guide sleeve, and including a pin carried by said post, said pin being capable of fitting within said slot when body is in a lower position with respect to said drain fitting and being capable of fitting against an edge of said cut-out in order to hold said body in an upper position with respect to said drain fitting.

8. A fitting member as claimed in 1 including:

an elastomeric member capable of forming a seal with said lip section when said fitting member is in said lower position carried by said body so as to extend outwardly therefrom, said body includes an internal, annular, threaded wall extending upwardly from the exterior of said shoulder and said body also includes a cap, said cap having a threaded exterior which is threaded into said internal annular wall in said body, said cap enclosing said nut means so as to prevent said post from being disassembled from said body in such a manner as to permit relative movement between said post and said body, said guide sleeve includes two longitudinal slots located on opposite sides of said sleeve so as to extend part way along the length of said sleeve from the lower end of said guide sleeve, a pin carried by said post, said pin being capable of fitting within said slots when body is in a lower position with respect to said drain fitting and being capable of fitting against the bottom of said sleeve in order to hold said body in an upper position with respect to said drain fitting after said body has been lifted to said upper position and turned so as to place said pin under said bottom.

9. A fitting member as claimed in 1 including:

an elastomeric member capable of forming a seal with said lip section when said fitting member is in said lower position carried by said body so as to extend outwardly therefrom, said body includes an internal, annular, threaded wall extending upwardly from the exterior of said shoulder and said body also includes a cap, said cap having a threaded exterior which is threaded into said internal annular wall in said body, said cap enclosing said nut means so as to prevent said post from being disassembled from said body in such a manner as to permit relative movement between said post and said body, said guide sleeve includes two longitudinal slots located on opposite sides of said sleeve so as to extend part way along the length of said sleeve from the lower end of said guide sleeve, and a rectangular cutout located at the intersection of each of said slots and the bottom of said guide sleeve, and including a pin carried by said post, said pin being capable of fitting within said slots when body is in a lower position with respect to said drain fitting and being capable of fitting against the edges of said cut-out in order to hold said body in an upper position with respect to said drain fitting after said body has been lifted to said upper position and turned so as to place said pin under said edge.

* * * * *